US011482406B2

(12) United States Patent
Yuki

(10) Patent No.: US 11,482,406 B2
(45) Date of Patent: Oct. 25, 2022

(54) DISCHARGE LAMP, DISCHARGE LAMP ELECTRODE, AND DISCHARGE LAMP ELECTRODE MANUFACTURING METHOD

(71) Applicant: Ushio Denki Kabushiki Kaisha, Tokyo (JP)

(72) Inventor: Takashi Yuki, Tokyo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/456,273

(22) Filed: Nov. 23, 2021

(65) Prior Publication Data

US 2022/0181139 A1 Jun. 9, 2022

(30) Foreign Application Priority Data

Dec. 3, 2020 (JP) ..... JP2020-200909

(51) Int. Cl.
*H01J 61/073* (2006.01)
*H01J 61/52* (2006.01)
*H01J 61/35* (2006.01)

(52) U.S. Cl.
CPC ..... *H01J 61/526* (2013.01); *H01J 61/35* (2013.01)

(58) Field of Classification Search
CPC ..... H01J 61/526; H01J 61/35; H01J 61/0732; H01J 9/02
See application file for complete search history.

(56) References Cited

FOREIGN PATENT DOCUMENTS

| | | | | |
|---|---|---|---|---|
| CN | 106298432 A | * | 1/2017 | ..... H01J 61/06 |
| DE | 102012006106 A1 | * | 10/2012 | ..... H01J 61/073 |
| JP | 2012-028168 A | | 2/2012 | |
| JP | 2017-016761 A | | 1/2017 | |

* cited by examiner

*Primary Examiner* — Donald L Raleigh
(74) *Attorney, Agent, or Firm* — Studebaker & Brackett PC

(57) ABSTRACT

At least one of the electrodes of a discharge lamp, including at an interior of a main body of the electrode: a heat-transmitting substance of the melting point lower than that of a material which makes up the main body; and a regulating body that is made up of a material of the melting point higher than that of the heat-transmitting substance, that includes a blade which extends in the axial direction and in a radial direction perpendicular to the axial direction, and that regulates convection of the heat-transmitting substance. Surface roughness Rz of at least one of a region which is on an inner wall face of the main body and with which the regulating body makes contact and a region which is on a surface of the regulating body and with which the inner wall face makes contact is not greater than 1.52 μm.

10 Claims, 7 Drawing Sheets

DISCHARGE LAMP, DISCHARGE LAMP ELECTRODE, AND DISCHARGE LAMP ELECTRODE MANUFACTURING METHOD

TECHNICAL FIELD

The present invention relates to a discharge lamp, a discharge lamp electrode, and a discharge lamp electrode manufacturing method.

BACKGROUND ART

Exposure apparatuses employed in operations for manufacturing semiconductor elements, liquid crystal display elements, and so forth have conventionally employed discharge lamps—especially short-arc-type discharge lamps—as light sources. At such a discharge lamp, an anode and a cathode are arranged in opposing fashion in an axial direction within an arc tube, and the interior of the arc tube is filled with mercury or other such light-emitting sub stance.

At such discharge lamp, because a large thermal load is applied to the electrodes when the lamp is lit, this causes occurrence of what is called the blackening problem in which overheating and so forth of the anode causes vaporization of electrode material, and this vaporized substance adheres to the inner wall of the arc tube, reducing the optical transmittance thereof.

A discharge lamp having a structure in which the interior of a sealed space within the anode is filled with a heat-transmitting substance has been proposed to solve this problem. The heat-transmitting substance becomes molten when the lamp is in its lit state, the overall anode temperature distribution causing convection thereof within the sealed space. Convection of this heat-transmitting substance is such that heat at the tip (the end nearest the cathode) of the anode is transmitted to the back end (the end farthest from the cathode) thereof, as a result of which the temperature at the tip of the anode is reduced, and the amount of electrode material that is vaporized is suppressed.

Patent Reference No. 1 and Patent Reference No. 2 describe causing a regulating body that regulates the convection of the heat-transmitting substance in the circumferential direction to be provided within the sealed space. Providing the regulating body within the sealed space prevents hole formation from occurring at the electrode tip due to convection in the circumferential direction of the heat-transmitting substance.

PRIOR ART REFERENCES

Patent References

Patent Reference No. 1: Japanese Laid-Open Patent Application Publication No. 2012-028168

Patent Reference No. 2: Japanese Laid-Open Patent Application Publication No. 2017-016761

SUMMARY OF INVENTION

Problem to be Solved by Invention

There has in recent times come to be market demand for discharge lamps having even higher output and longer life. Because increasing the output of a discharge lamp will place increased thermal load on the electrodes, it is necessary to design electrodes that can withstand thermal loads for long periods of time. It is an object of the present invention to provide a discharge lamp permitting achievement of higher output and longer life, and an electrode to be arranged at the interior of the discharge lamp.

Means for Solving Problem

To investigate the thermal load on an electrode when a discharge lamp is used at high output, the present inventor used a radiation thermometer to measure the temperature distribution at the surface of the electrode when the lamp was lit. As a result of measurement, the present inventor realized that there are discharge lamps for which the range of local fluctuation in temperature at the electrode surface is large. Fluctuation in temperature refers to fluctuations in temperature which occur during a short period of time (e.g., one minute). If a state in which the range of fluctuation in temperature at the interior surface of the electrode is large continues for an extended period of time, deformations resulting from high-temperature creep will cause occurrence of deformations in which projections are made to protrude from the interior surface of the electrode tip, and holes will form at the electrode tip, leading to leakage of the heat-transmitting substance. This being the case, because the electrode will lose its ability to achieve improved heat dissipating performance, the life of the discharge lamp will be shortened.

While described in further detail below, upon analyzing why the range of local fluctuation in temperature at the interior surface of the electrode became large, it was discovered that the regulating body for regulating convection of the heat-transmitting substance was binding to the inner wall face of the electrode while still inclined with respect to the axis of the electrode, causing the heat-transmitting substance to be in a constant state of turbulence. The present inventor therefore devised the following discharge lamp so as to prevent the regulating body from binding to the inner wall face of the electrode in a state in which it is inclined with respect to the axis of the electrode.

The present invention is a discharge lamp in which a pair of electrodes are arranged in opposing fashion in an axial direction at an interior thereof, and in which at least one of the electrodes includes, at an interior of a main body of the electrode:

- a heat-transmitting substance of the melting point lower than that of a material which makes up the main body; and
- a regulating body that is made up of a material of the melting point higher than that of the heat-transmitting substance, that includes a blade which extends in the axial direction and in a radial direction perpendicular to the axial direction, and that regulates convection of the heat-transmitting substance, wherein surface roughness Rz of at least one of a region which is on an inner wall face of the main body and with which the regulating body makes contact and a region which is on a surface of the regulating body and with which the inner wall face makes contact is not greater than 1.52 μm.

Binding of the regulating body to the inner wall face of the electrode occurs when the regulating body makes contact with and gets stuck on the inner wall face, and the regulating body is made unable to move due to the convection of the heat-transmitting substance. By causing the surface roughness of region(s) at which contact occurs between the regulating body and the inner wall face to satisfy the foregoing numeric range, it is possible to achieve a situation such that even if the regulating body were to come in contact with the inner wall face, the regulating body would not become stuck on the inner wall face but would slide thereagainst. This will make it possible to suppress binding of the regulating body on the inner wall face, which might otherwise cause the heat-transmitting substance to be in a constant state of turbulence. By so doing, it will be possible to prevent the heat-transmitting substance from being in a constant state of turbulence, and to reduce the range of local fluctuation in temperature at the interior surface of the electrode.

Moreover, when the regulating body comes in contact with and slides against the inner wall face, it may be that the regulating body will be returned to a state in which it does not come in contact with the inner wall face. Or when the regulating body comes in contact with and slides against the inner wall face, it may be that it will transition to an inclination in a direction of extension of the blade(s), in which state it will tend not to cause occurrence of turbulence (as described in further detail below). This will therefore make it less likely that the heat-transmitting substance will remain in a turbulent state.

By suppressing occurrence of a situation in which the heat-transmitting substance is in a constant state of turbulence, the range of local fluctuation in temperature at the electrode surface will be reduced. This will make it possible to prevent formation of holes at the electrode tip due to deformations resulting from high-temperature creep, to cause the ability of the electrode to achieve improved heat dissipating performance to be maintained for a long period of time, and to attain long life even when the discharge lamp is used at high output.

Surface roughness Rz of the region which is on the inner wall face of the main body and with which the regulating body makes contact and the region which is on the surface of the regulating body and with which the inner wall face makes contact may both be not greater than 1.52 μm. This will further facilitate sliding of the regulating body against the inner wall face and prevent the regulating body from binding on the inner wall face.

The inner wall face may include a first inner wall face which extends in parallel fashion with respect to a radial direction at a tip portion of the main body, a second inner wall face which extends in parallel fashion with respect to the axial direction, and a third inner wall face which connects the first inner wall face and the second inner wall face; wherein the second inner wall face and the third inner wall face are such that surface roughness Rz thereof is not greater than 1.52 μm on the entire respective inner wall faces. The first inner wall face may be such that surface roughness Rz thereof is not greater than 1.52 μm on the entire inner wall face. This will make it possible to reduce formation of turbulence by the heat-transmitting substance when the heat-transmitting substance comes in contact with the first inner wall face, the second inner wall face, and/or the third inner wall face as it undergoes convection.

By reducing the surface roughness of not only region(s) of the electrode inner wall face(s) with which the regulating body makes contact but also of the entire first inner wall face and/or the entire second inner wall face, it will be possible to suppress occurrence of turbulence that might otherwise be produced when the heat-transmitting substance collides with the entire first inner wall face and/or the entire second inner wall face.

In accordance with the present invention, an electrode which is arranged at an interior of a discharge lamp and which exhibits a shape of a solid of revolution, includes, at an interior of a main body of the electrode:

a heat-transmitting substance of the melting point lower than that of a material which makes up the electrode; and a regulating body that is made up of a material of the melting point higher than that of the heat-transmitting substance, that includes a blade which extends in an axial direction of the solid of revolution and in a radial direction perpendicular to the axial direction, and that regulates convection of the heat-transmitting substance, wherein surface roughness Rz of at least one of a region which is on an inner wall face of the main body and with which the regulating body makes contact and a region which is on a surface of the regulating body and with which the inner wall face makes contact is not greater than 1.52 μm.

In accordance with the present invention, a method for manufacturing an electrode of a discharge lamp including the steps of:

preparing a main body having an internal space and making up the electrode which is arranged at an interior of the discharge lamp; a heat-transmitting substance of the melting point lower than that of the main body; and a regulating body that is for regulating convection of the heat-transmitting substance and that exhibits a size permitting insertion within the internal space such that a gap intervenes therebetween; and polishing so as to cause surface roughness Rz of at least one of a region which is on an inner wall face of the main body and with which the regulating body makes contact and a region which is on a surface of the regulating body and with which the inner wall face makes contact is not greater than 1.52 μm.

Benefit of Invention

It is possible to provide a discharge lamp permitting achievement of higher output and longer life, and an electrode to be arranged at the interior of the discharge lamp.

BRIEF DESCRIPTION OF DRAWINGS

FIG. 7B Top view showing the inclination of a regulating body and the flow of a heat-transmitting substance.

FIG. 8B Top view showing the inclination of a regulating body and the flow of a heat-transmitting substance.

FIG. 9B Top view showing the inclination of a regulating body and the flow of a heat-transmitting substance.

EMBODIMENTS FOR CARRYING OUT INVENTION

Figure 1:
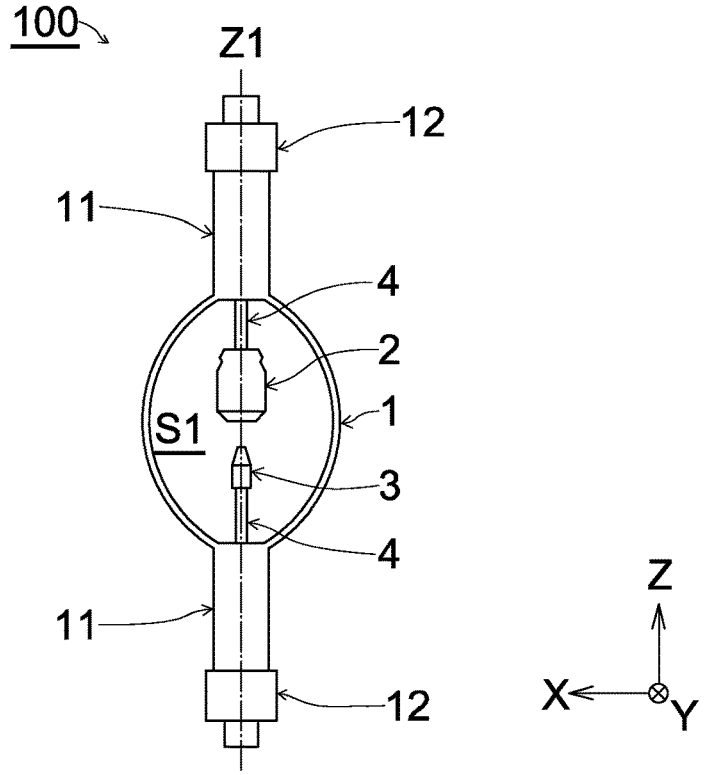
FIG. 1 Drawing showing an overview of a discharge lamp.

Respective embodiments of discharge lamps will be described with reference to the drawings. As the attached respective drawings are schematic representations, note that the dimensional ratios shown in the drawings are not necessarily consistent with actual dimensional ratios, nor are the dimensional ratios shown necessarily consistent between respective drawings.

Figure 9A:
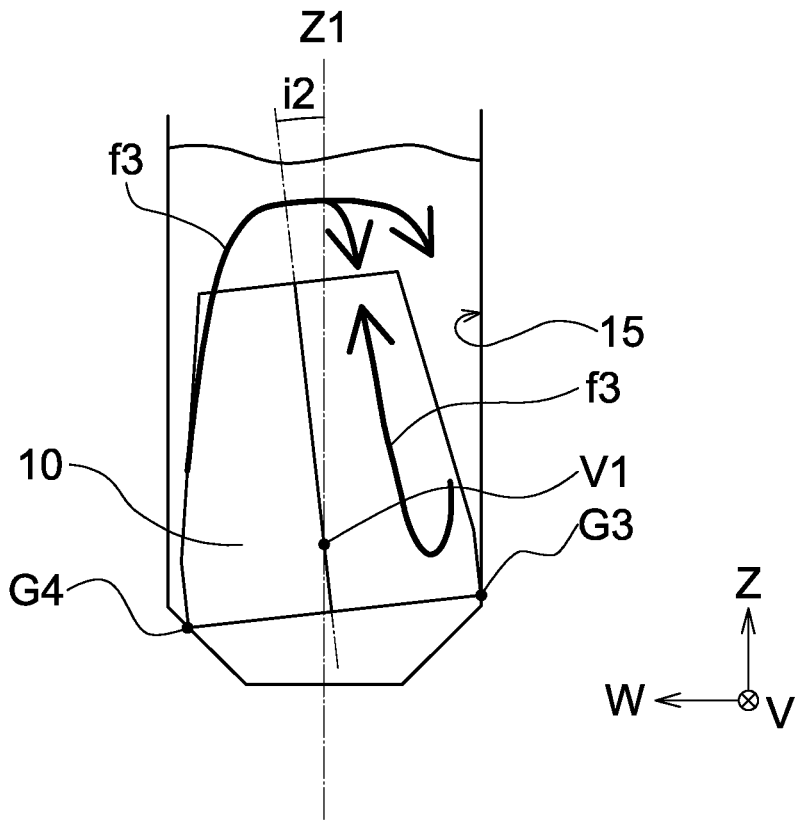
FIG. 9A Side view showing the inclination of a regulating body and the flow of a heat-transmitting substance.
Figure 9B:
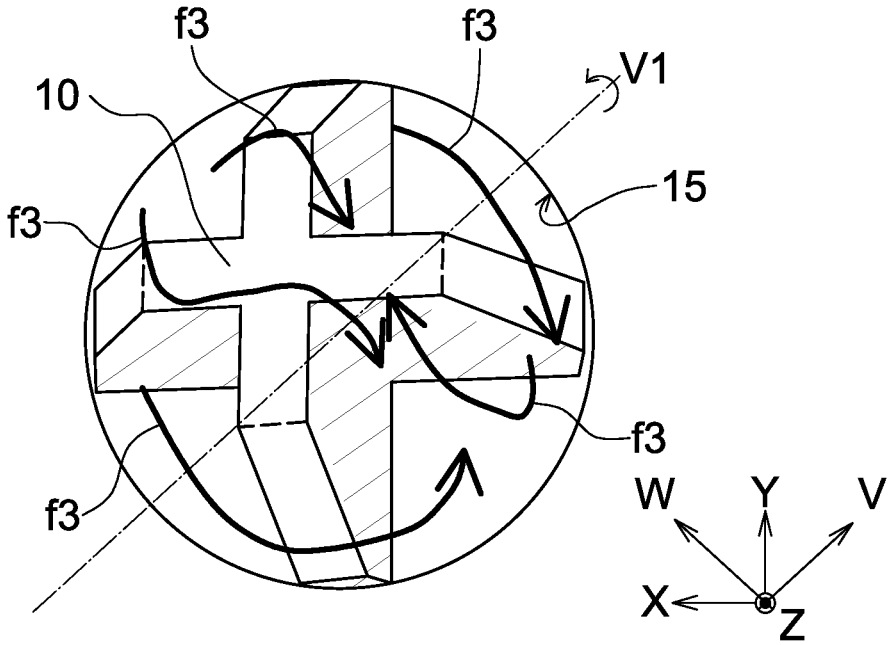

Below, description of the respective drawings except for FIG. 9A and FIG. 9B is carried out with reference to an XYZ coordinate system. FIG. 9A and FIG. 9B will be described below. Throughout the present specification, in referring to directions, where a distinction is to be made between positive and negative senses of a direction, note that this will be indicated by appending a plus or minus sign thereto as in the "+X direction" and the "−X direction". Where no distinction is to be made between positive and negative senses of a direction, reference will be made to simply the "X direction". That is, throughout the present specification, when reference is made to simply the "X direction", this should be understood to include both the "+X direction" and the "−X direction". The same thing is likewise true with respect to the Y direction and the Z direction. At the embodiments described below, the −Z direction indicates the direction of gravity.

First Embodiment

Overview of Discharge Lamp

An overview of a discharge lamp which is an embodiment of the present invention will be described with reference to FIG. 1. The discharge lamp 100 is a short-arc-type discharge lamp provided with an arc tube 1, an anode 2 and a cathode 3 which are arranged in opposing fashion in the direction in which the Z1 axis extends at the interior of the arc tube 1, and lead rods 4 which respectively support the anode 2 and the cathode 3.

"Short-arc-type discharge lamp" refers to a discharge lamp in which the anode 2 and the cathode 3 are arranged such that the gap therebetween is not greater than 40 mm (this value being as measured at normal temperature when not subject to thermal expansion). Examples of such discharge lamps include discharge lamps for which rated power is 2 kW to 35 kW that are used in exposure apparatuses employed in operations for manufacturing semiconductor elements, liquid crystal display elements, and/or the like. At the discharge lamp 100 of the present embodiment, note that the anode 2 and the cathode 3 are arranged such that the gap therebetween is 6 mm.

The arc tube 1, the anode 2, the cathode 3, and the lead rods 4 are each arranged so as to be centered on the Z1 axis. The anode 2 is arranged above (at the +Z side of) the cathode 3. A sealed tube 11 is provided at each end of the arc tube 1 in the direction in which the Z1 axis extends. Bases 12 which are electrically connected to the lead rods 4 are attached to the sealed tubes 11.

The arc tube 1 is formed from a glass tube. The arc tube 1 has a region in which the inside diameter of the glass tube increases as one proceeds toward the center from either of the respective ends of the Z1 axis. This region at which the inside diameter increases may exhibit a spheroidal or ellipsoidal shape. The glass tube might employ quartz glass, for example. The region at which the inside diameter increases functions as a light-emitting space S1. Besides mercury or other such light-emitting substance, the light-emitting space S1 may be filled as appropriate with argon gas, xenon gas, and/or other such buffer gas to assist during starting.

Overview of the Anode

Figure 2:
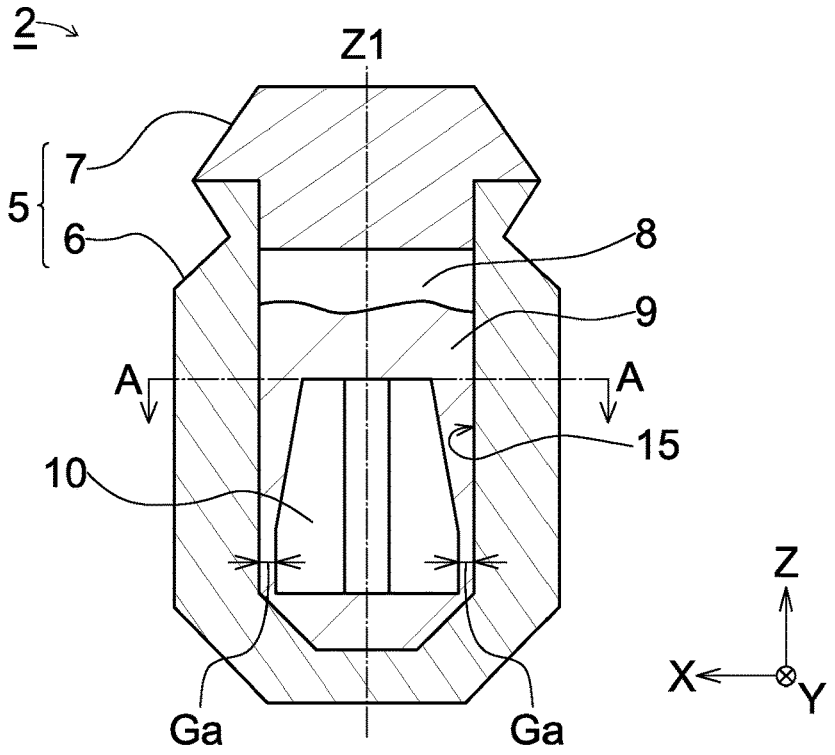
FIG. 2 Sectional view of an anode at a discharge lamp in accordance with a first embodiment.
Figure 3:
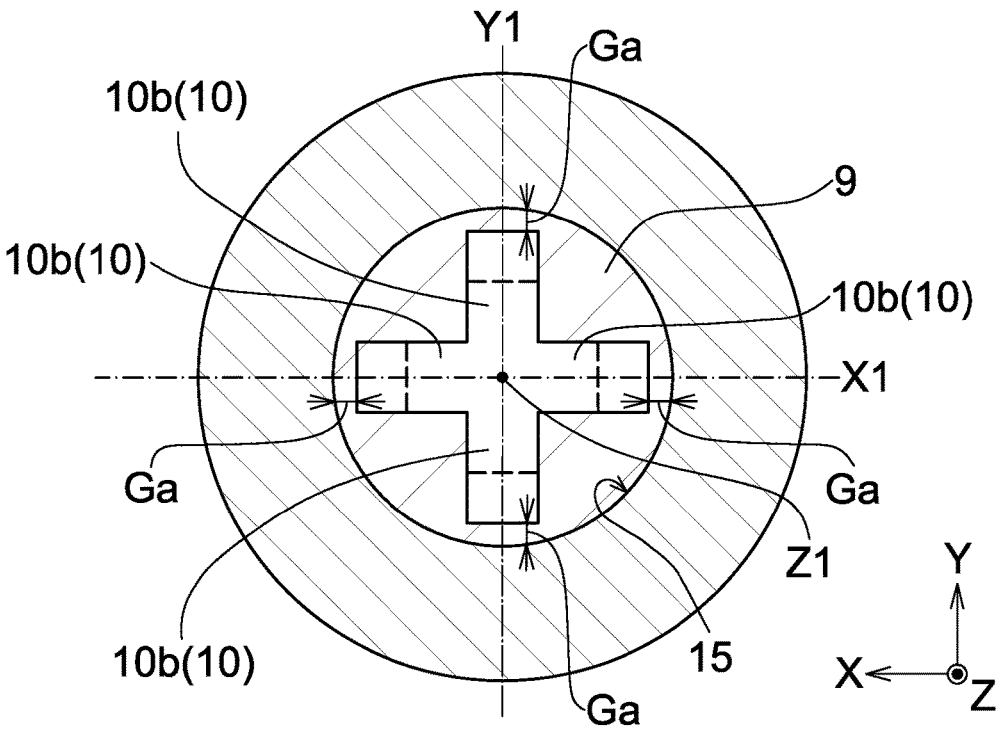
FIG. 3 Sectional view of section A-A in FIG. 2 as viewed in the direction of the arrows.

An overview of the anode will be described with reference to FIG. 2 and FIG. 3. FIG. 2 is an enlarged sectional view of the anode 2. FIG. 2 shows a section taken along a plane through which the Z1 axis passes. At FIG. 2, to better understand the shape of the regulating body, note that the regulating body is not shown in sectional view but is shown in such fashion as to include contour lines of the surface. FIG. 3 is a sectional view of section A-A in FIG. 2 as viewed in the direction of the arrows.

The anode 2 will be described with reference to FIG. 2. The anode 2 exhibits the shape of a solid of revolution about the Z1 axis. The anode 2 has a main body 5, a heat-transmitting substance 9, and a regulating body 10. The heat-transmitting substance 9 and the regulating body 10 are arranged in an internal space 8 of the main body 5. The main body 5 includes a container 6 and a cap 7. When the cap 7 is installed on the container 6, the sealed internal space 8 is formed at the main body 5. When there is a space at the internal space 8 that has not been completely filled by the heat-transmitting substance 9 and the regulating body 10, the space may be filled with an inert gas (e.g., argon).

The heat-transmitting substance 9 is made up of a material that is a liquid at the high temperatures which exist when the discharge lamp 100 is lit but that is a solid when at the low temperatures which exist when the discharge lamp 100 is not lit. When the discharge lamp 100 is lit, the molten heat-transmitting substance 9 experiences convection primarily in the vertical direction (Z direction) within the internal space 8. Such convection in the vertical direction causes heat in the vicinity of the tip of the anode 2 to be transmitted toward the back end of the anode 2.

When viewed from a location thereabove (at the +Z side thereof) to a location therebelow (at the −Z side thereof) as is the case at FIG. 3, the regulating body 10 of the present embodiment exhibits a cruciform shape such that a plate extending in the X direction and a plate extending in the Y direction intersect at a center which is the Z1 axis. The regulating body 10 need not necessarily be manufactured by combination of two plates. For example, the regulating body 10 may be manufactured by integral molding.

Regarding such a regulating body 10 that exhibits a cruciform shape it may be said—to state this another way—that this exhibits a shape such that four blades 10*b* extending in the direction in which the Z1 axis extends and toward the exterior in radial directions from the Z1 axis are respectively arranged at intervals of 90° about the Z1 axis. The four blades 10*b* regulate convection in the circumferential direction, which is the direction of circulation about the Z1 axis, of the heat-transmitting substance 9. As a result, this makes it possible to reduce the range of local fluctuation in temperature at the interior surface of the electrode, and makes it possible to prevent damage to the anode 2. The main body 5, the heat-transmitting substance 9, and the regulating body 10 will be described in further detail below.

Main Body

Figure 4:
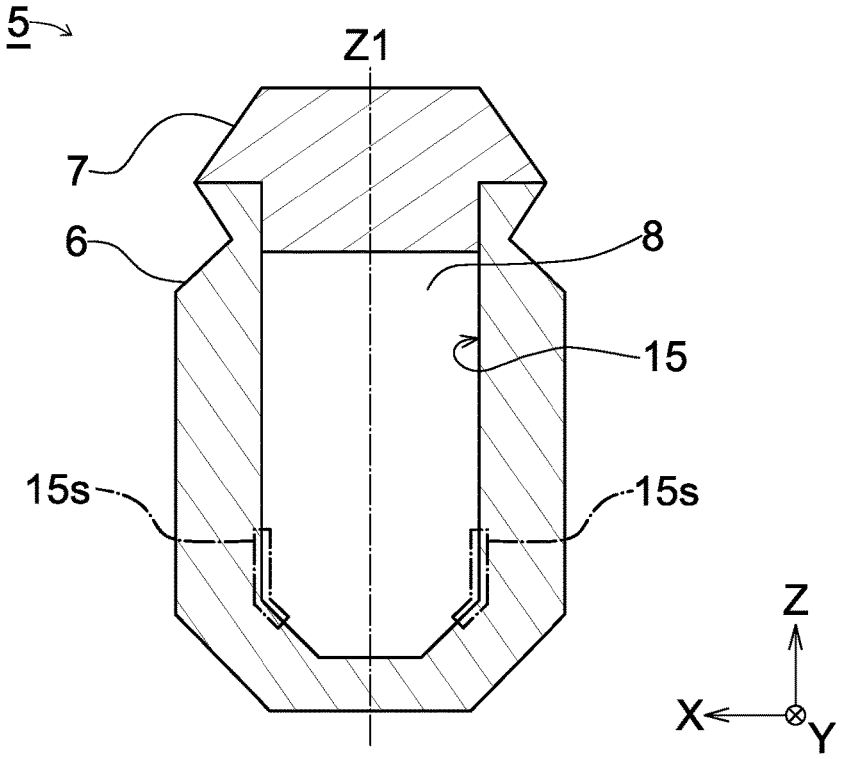
FIG. 4 Sectional view taken along a plane through which the Z1 axis of the main body passes.

The main body 5 will be described with reference to FIG. 4. FIG. 4 shows a section taken along a plane through which the Z1 axis of the main body 5 passes. The main body 5 has an inner wall face 15 that comes in contact with the internal space 8. The inner wall face 15 has a region 15*s* with which the regulating body 10 of the present embodiment makes contact.

Throughout the present specification, "region(s) with which the regulating body 10 makes contact" are not only region(s) on the inner wall face 15 that are actually currently in contact with the regulating body 10 but also include region(s) on the inner wall face 15 that are capable of coming in contact with the regulating body 10 because of the relationship between the sizes and shapes of the regulating body 10 and the inner wall face 15. In addition, it is preferred that surface roughness Rz of the region(s) 15*s* with which the regulating body 10 makes contact be not greater than 1.52 μm. Detailed description with respect to surface roughness is given below.

So that the main body 5 does not melt when the discharge lamp 100 is lit, the main body 5 is made up of high-melting point material. In accordance with the present embodiment, the main body 5 (the container 6 and the cap 7) are made up of material(s) which primarily include tungsten.

Heat-Transmitting Substance

As described above, the heat-transmitting substance 9 is made up of a material that exhibits a liquid state when the discharge lamp 100 is lit but that exhibits a solid state when the discharge lamp 100 is not lit. The melting point of the heat-transmitting substance 9 is lower than the melting point of the material that makes up the main body 5. The material that makes up the heat-transmitting substance 9 is made up of a thermally conductive material. In accordance with the present embodiment, the heat-transmitting substance 9 employs material(s) which primarily include silver. However, the heat-transmitting substance 9 may employ material(s) which primarily include gold.

Regulating Body

So that the regulating body 10 does not melt when the discharge lamp is lit, the melting point of the material making up the regulating body 10 is higher than the melting point of the material making up the heat-transmitting substance 9. The material of the regulating body 10 may be the same as the material making up the main body 5. The regulating body 10 is made up of material(s) which primarily include tungsten.

Figure 5:
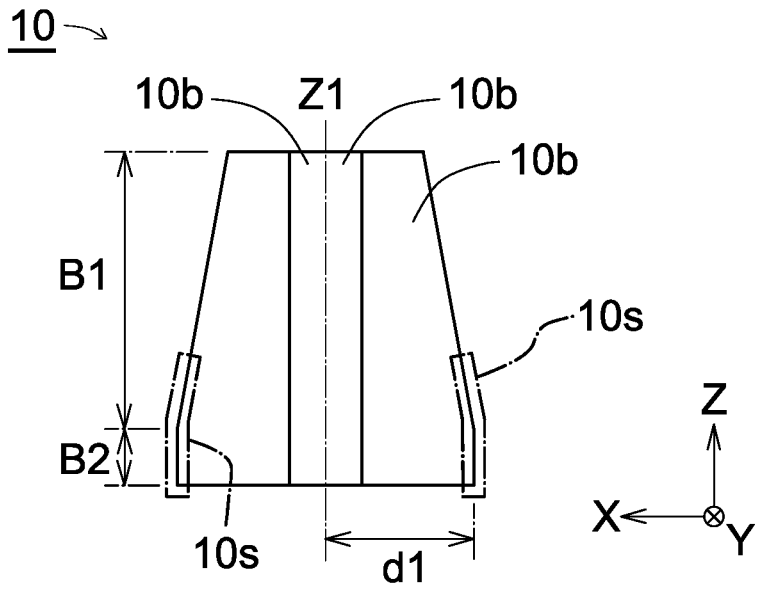
FIG. 5 Side view of a regulating body.
Figure 6:
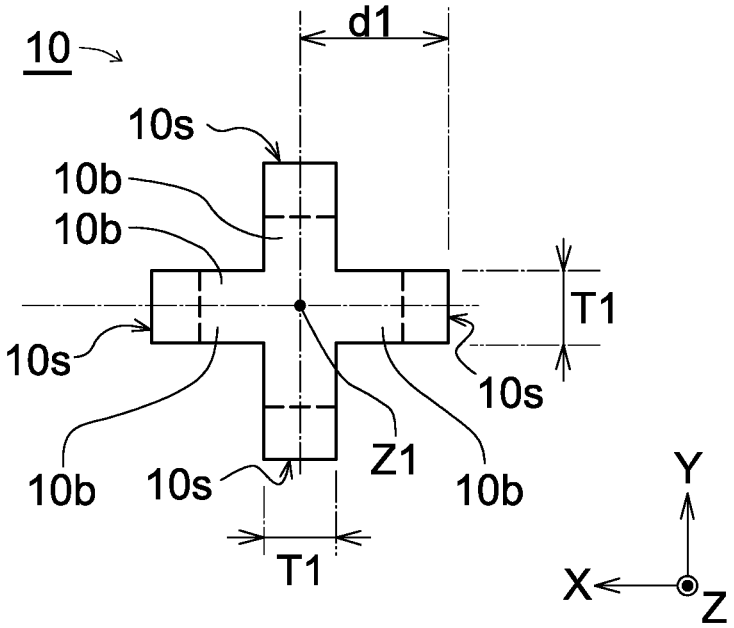
FIG. 6 Top view of a regulating body.

The shape of the regulating body 10 will be described with reference to FIG. 5 and FIG. 6. FIG. 5 and FIG. 6 show the regulating body 10. FIG. 5 is a side view of the regulating body 10 as the regulating body 10 is seen when viewed from a location at the −Y side thereof to a location at the +Y side thereof. FIG. 6 is a top view of the regulating body 10 as the regulating body 10 is seen when viewed from a location at the +Z side thereof to a location at the −Z side thereof.

As can be seen in FIG. 5, the regulating body 10 is made up of a tapered portion B1 at which diameter decreases as one proceeds in the +Z direction, and a uniform diameter portion B2 at which diameter is constant in the Z direction. The maximum radius dl of the regulating body 10 is at the uniform diameter portion B2. The region 10*s* in FIG. 5 is a region that comes in contact with the inner wall face 15 (see FIG. 4). The region 10*s* with which the inner wall face 15 makes contact is made up of the exterior face of the uniform diameter portion B2 and that portion of the exterior face of the tapered portion B1 which is in the vicinity of the uniform diameter portion B2.

Throughout the present specification, "region(s) with which the inner wall face 15 makes contact" are not only region(s) on the regulating body 10 that are actually currently in contact with the inner wall face 15 but also include region(s) on the regulating body 10 that because of the relationship between the sizes and shapes of the regulating body 10 and the inner wall face 15 are capable of coming in contact with the inner wall face 15. In addition, it is preferred that surface roughness Rz of the region(s) 10*s* of the regulating body 10 with which the inner wall face 15 makes contact be not greater than 1.52 Detailed description with respect to surface roughness is given below.

Referring to FIG. 6, the thickness T1 of the four blades 10*b* that make up the regulating body 10 is a thickness which is capable of withstanding impact by the heat-transmitting substance 9 as it undergoes convection. The thickness thereof might for example be not less than 1 mm, it being preferred that this be not less than 2 mm but not greater than 3 mm.

It so happens as shown in FIG. 2 and FIG. 3 that there is a gap Ga between the inner wall face 15 and the location at which the regulating body 10 is nominally arranged. This gap Ga is provided so that the regulating body 10 which undergoes thermal expansion as it experiences an increase in temperature when the discharge lamp is lit, for example, does not cause it to come in contact with the inner wall face 15 and to press on the inner wall face 15. On the other hand, the existence of the gap Ga makes it possible for there to be occurrence of inclination of the regulating body 10 with respect to the Z1 axis, displacement of the central axis of the regulating body 10 relative to the Z1 axis, and/or rotation of the regulating body 10, when the regulating body 10 is pressed on by the heat-transmitting substance 9 as it undergoes convection at a time when the discharge lamp is lit.

When the direction of convection of the heat-transmitting substance 9 is altered due to inclination or the like of the regulating body 10, this increases the range of local fluctuation in temperature at the interior surface of the anode 2. As described above, there is a possibility that the anode 2 will suffer damage if the state in which there is an increased range of fluctuation in temperature persists for an extended period of time.

It is therefore preferred that the range of local fluctuation in temperature at the anode 2 be small. Throughout the present specification, the range of fluctuation in temperature is defined as the difference between the maximum temperature and the minimum temperature measured at an arbitrary portion on the surface of the anode 2 during the course of a one-minute period at a time when the discharge lamp 100 is in a lit state but the discharge lamp 100 as a whole is not experiencing a rise in temperature (such as would be the case were measurement to be carried out immediately after the lamp has been lit, for example). It is preferred that the range of fluctuation in temperature of the anode 2 be within 10° C.

Above, a brief description has been given of the effect that convection of the heat-transmitting substance 9 has on the range of fluctuation in temperature of the anode 2. Description will next be given with respect to the results of analysis regarding what sort of inclinations of the regulating body 10 might cause there to be a large range of fluctuation in temperature.

Regulating Body Inclination and Temperature Fluctuation

Figure 7A:
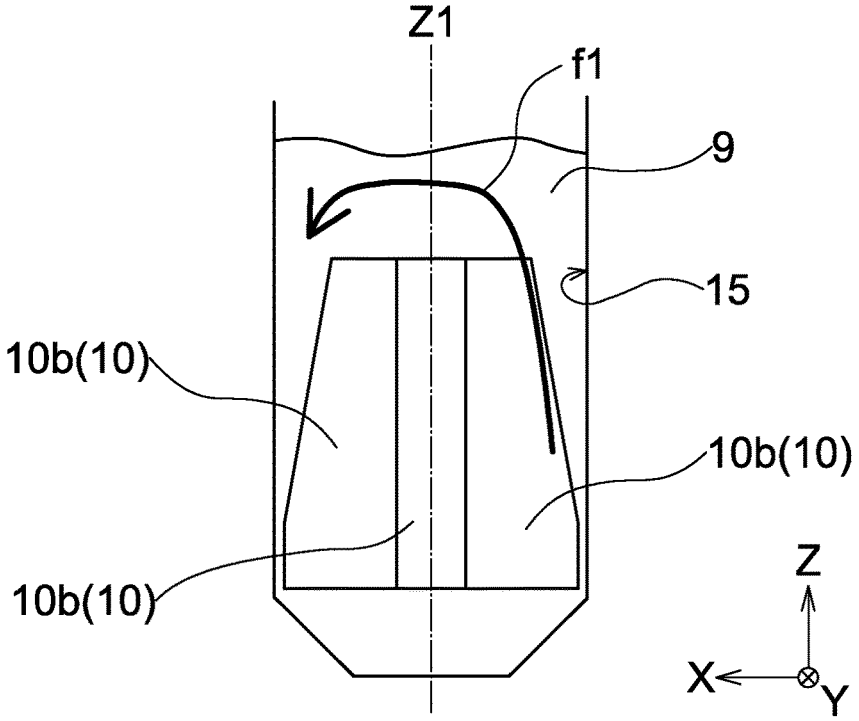
FIG. 7A Side view showing the inclination of a regulating body and the flow of a heat-transmitting substance.
Figure 7B:
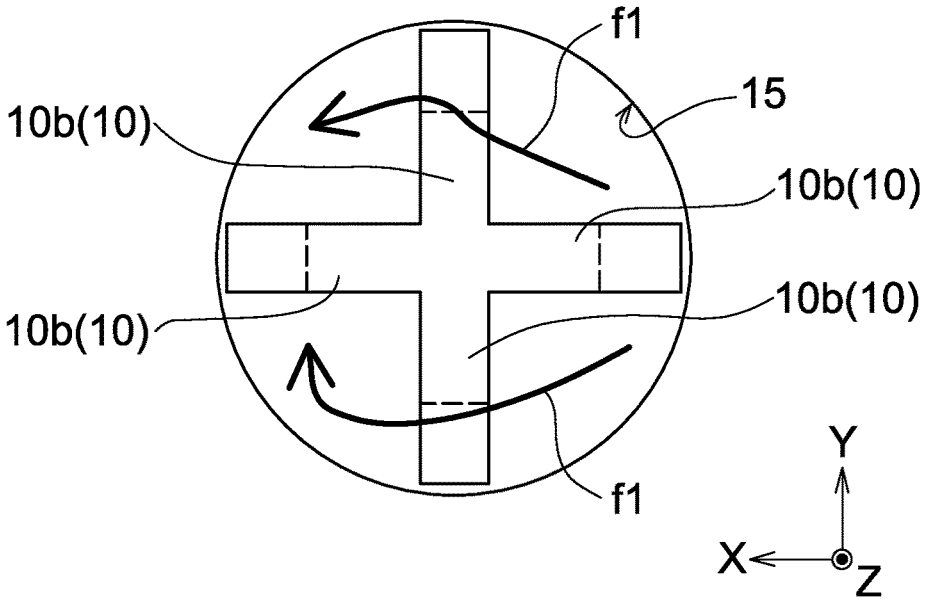
Figure 8A:
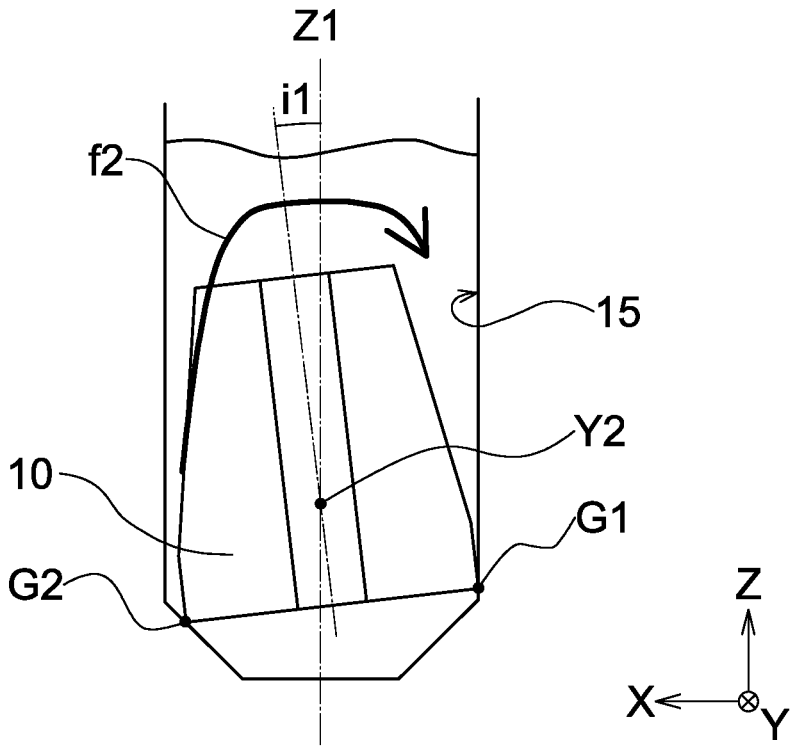
FIG. 8A Side view showing the inclination of a regulating body and the flow of a heat-transmitting substance.
Figure 8B:
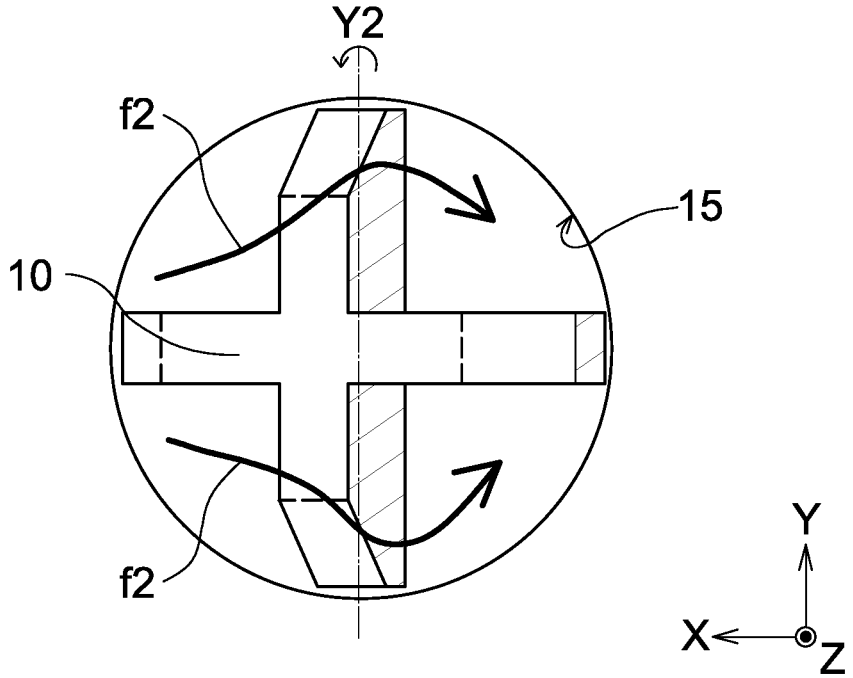

Computer simulations were carried out regarding the inclination of the regulating body 10, the convection of the heat-transmitting substance 9, and the temperature fluctuation in accordance with the present embodiment. FIG. 7A, FIG. 8A, and FIG. 9A are side views showing the inclination of the regulating body 10 and the flow of the heat-transmitting substance 9. FIG. 7B, FIG. 8B, and FIG. 9B are top views showing the inclination of the regulating body 10 and the flow of the heat-transmitting substance 9.

FIG. 7A and FIG. 7B show a situation in which the regulating body 10 is arranged at its nominal location and in which there is no inclination thereof with respect to the Z1 axis.

FIG. 8A and FIG. 8B show a situation in which the regulating body 10 is inclined by an angle of i1 with respect to the Z1 axis. As shown in FIG. 8A, the regulating body 10 comes in contact with the inner wall face 15 at a point G1 and at a point G2. In accordance with the present embodiment, the inclination angle i1 that exists when the regulating body 10 and the inner wall face 15 come in contact at the point G1 and at the point G2 is 7.0 degrees (deg.). The hatched region at FIG. 8B indicates the side face of the regulating body 10 that has come to be visible from the top as a result of the inclination of the regulating body 10. The same is true with respect to FIG. 9B, described below.

FIG. 9A and FIG. 9B show a situation in which the regulating body 10 is inclined by i2 with respect to the Z1 axis. As shown in FIG. 9A, the regulating body 10 comes in contact with the inner wall face 15 at a point G3 and at a point G4. In accordance with the present embodiment, the inclination i2 that exists when the regulating body 10 and the inner wall face 15 come in contact at the point G3 and at the point G4 is 8.7 degrees (deg.). Note that FIG. 9B also additionally shows the V axis which is parallel to the V1 axis which is the axis of rotation of the inclination of the regulating body 10, and the W axis which is perpendicular to the V axis and the Z axis, which are described below. At FIG. 9A, the regulating body 10 is shown on a coordinate system which includes the W axis and the V axis.

At FIG. 8A and FIG. 8B, the inclination of the regulating body 10 is an inclination that is in a direction of extension of the blades; at FIG. 9A and FIG. 9B, the inclination of the regulating body 10 is an inclination that is not in a direction of extension of the blades. Description will be given with respect to "inclination in a direction of extension of the blades" and "inclination not in a direction of extension of the blades".

Throughout the present specification, the directions in which the blades 10*b* that make up the regulating body 10 extend in radial directions from the Z1 axis are referred to as "directions of extension of the blades". In the case of the regulating body 10 of the present embodiment, the blades 10*b* extend in radial directions from the Z1 axis so as to be parallel to the X axis and the Y axis. The directions of extension of the blades of the regulating body 10 are therefore the directions of the X axis and the Y axis. If the axis of rotation of the inclination of the regulating body 10 is an axis which is parallel to the X axis or an axis which is parallel to the Y axis, the inclination of the regulating body 10 will therefore correspond to the inclination of a direction of extension of the blades. At FIG. 8A and FIG. 8B, the axis of rotation of the inclination of the regulating body 10 is the Y2 axis which is parallel to the Y axis. For this reason, the inclination of the regulating body 10 at FIG. 8A and FIG. 8B corresponds to the inclination of a direction of extension of the blades.

Throughout the present specification, a direction that is not parallel to any direction in which the blades 10*b* that make up the regulating body 10 extend in radial directions from the Z1 axis is referred to as "a direction not in a direction of extension of the blades". In the case of the regulating body 10, the blades 10*b* extend in radial directions from the Z1 axis so as to be parallel to the X axis and the Y axis. If the axis of rotation of the inclination of the regulating body 10 is an axis which is parallel to neither the X axis nor the Y axis, the inclination of the regulating body 10 will therefore correspond to an inclination that is not in a direction of extension of the blades. At FIG. 9A and FIG. 9B, the axis of rotation of the inclination of the regulating body 10 is an inclination that is rotated about the V1 axis, the V1 axis being parallel to neither the X axis nor the Y axis. For this reason, the inclination of the regulating body 10 at FIG. 9A and FIG. 9B corresponds to an inclination that is not in a direction of extension of the blades.

Arrows f1 through f3 shown in FIG. 7A, FIG. 7B, FIG. 8A, FIG. 8B, FIG. 9A, and FIG. 9B show the direction of convection of the molten heat-transmitting substance 9 when the discharge lamp is lit as determined by simulation. Flow of the heat-transmitting substance 9 forms so as to avoid the regulating body 10. The flow f1 shown in FIG. 7A and FIG. 7B, and the flow f2 shown in FIG. 8A and FIG. 8B, is comparatively simple, no turbulence being formed thereat. In contradistinction thereto, the flow f3 shown in FIG. 9A and FIG. 9B is comparatively complex, portions of the flow f3 mutually colliding and forming turbulence. The turbulence causes large changes in the direction of flow to occur as a function of time. In addition, there will be a large increase in the range of fluctuation in temperature at local regions of the main body 5 which are near the turbulence.

Above, description has been given with respect to the fact that whereas the heat-transmitting substance 9 tends not to form turbulence and the range of local fluctuation in temperature at the main body 5 is small at FIG. 7A and FIG. 7B in which the regulating body 10 is not inclined with respect to the Z1 axis and at FIG. 8A and FIG. 8B in which the regulating body 10 has an inclination with respect to the Z1 axis that is in a direction of extension of the blades, the heat-transmitting substance 9 does form turbulence and the range of local fluctuation in temperature at the main body 5 is large at FIG. 9A and FIG. 9B in which the regulating body 10 has an inclination with respect to the Z1 axis that is not in a direction of extension of the blades.

Regulating Body Inclination and Surface Roughness

The present inventor learned as a result of intensive research that it is possible for the regulating body 10 to become inclined and come in contact with the inner wall face 15, for the regulating body 10 to—depending on the friction that exists between it and the inner wall face 15—get stuck such that the regulating body 10 can no longer move, and for the regulating body 10 to bind to the inner wall face 15. In addition, it was learned that the range of local fluctuation in temperature at the main body 5 increases when the regulating body 10 binds to the inner wall face 15 in such fashion that it remains in an inclination that is not in a direction of extension of the blades and that causes formation of turbulence.

With the goal of reducing the range of local fluctuation in temperature at the main body 5, the present inventor therefore devised a method in which the surface roughness of region(s) with which the regulating body 10 makes contact and/or region(s) with which the inner wall face 15 makes contact is reduced so as to prevent the regulating body 10 from binding to the inner wall face 15.

When the surface roughness of region(s) with which the regulating body 10 makes contact and/or region(s) with which the inner wall face 15 makes contact is small, it will be the case even were the regulating body 10 to come in contact with the inner wall face 15 that the regulating body 10 will more easily slide against the inner wall face 15, as a result of which it will be possible to suppress occurrence of situations in which binding occurs when the regulating body 10 is in an inclined state. For example, even if the regulating body 10 should become inclined in a direction that is not in a direction of extension of the blades, which could cause the range of fluctuation in temperature to increase, the regulating body 10 would slide against the surface of the region(s) 15*s*, causing the regulating body 10 to return to a state in which it is not inclined and/or causing it to change to an inclination that is in a direction of extension of the blades. In other words, when surface roughness is small, this will make it possible to prevent the regulating body 10 from remaining in an inclination that is not in a direction of extension of the blades and that could cause the range of fluctuation in temperature to increase.

Based on the Coulomb friction model, the coefficient of friction is determined by the surface roughness of the two objects, i.e., the regulating body 10 and the inner wall face 15, that are in mutual contact. However, because in practice there is a limit to the effect that surface roughness has on the coefficient of friction, it is sufficient to cause the surface roughness of either those region(s) 15*s* on the inner wall face 15 of the main body 5 with which the regulating body 10 makes contact, or those region(s) 10*s* on the surface of the regulating body 10 with which the inner wall face 15 makes contact, to be not greater than some prescribed value. Of course, the surface roughness of those region(s) 15*s* on the inner wall face 15 of the main body 5 with which the regulating body 10 makes contact, and of those region(s) 10*s* on the surface of the regulating body 10 with which the inner wall face 15 makes contact, may both be made not greater than some prescribed value(s). Such control of surface roughness may be accomplished by causing the regulating body 10 and/or the inner wall face 15 of the main body 5 to undergo electrolytic polishing, lapping, and/or other such polishing.

Prescribed Value for Surface Roughness

The prescribed values for surface roughness are defined in terms of the surface roughness Rz. The surface roughness Rz indicates the maximum height of a surface. The surface roughness Rz is expressed as the sum of the height of the maximum convexity and the depth of the deepest concavity extracted over the sampling length from a portion of the roughness curve obtained as a result of measurement with a profilometer. Because the heights of convexities and the depths of concavities at surface irregularities on which the regulating body 10 and the inner wall face 15 are most likely to get stuck can be controlled, it is possible to suppress the risk that high convexities and/or especially low concavities will cause the regulating body 10 to get stuck on the inner wall face 15. For this reason, in accordance with the present invention, the prescribed values for surface roughness are defined in terms of the surface roughness Rz.

To determine the surface roughness that will make it possible to reduce the range of local fluctuation in temperature at the main body 5, testing was carried out as follows. First, six sets—each of which had a main body 5 (a container 6 and a cap 7) of an anode 2 having an internal space 8, a heat-transmitting substance 9, and a regulating body 10 exhibiting a size permitting insertion within the internal space 8 such that a gap Ga intervened therebetween—were prepared.

Next, those regions 15*s* on the inner wall face 15 of the main body 5 which came in contact with the internal space 8 and with which the regulating body 10 made contact were polished. The surface roughness Rz at the regions 15*s* with which the regulating body 10 came in contact were made to respectively differ by varying the conditions under which the polishing was carried out. And also with respect to the surface roughness Rz at those regions 10*s* on the surface of the regulating body 10 with which the inner wall face 15 came in contact, the surface roughness Rz were made to respectively differ by varying the conditions under which the polishing was carried out.

The heat-transmitting substance 9 and the regulating body 10 were inserted in the container 6 of the main body 5, this was then filled with an inert gas, and the cap 7 was mated with the container 6, to prepare each of the six anodes.

The foregoing was carried out to prepare six types of anodes (Sample 1 through Sample 6) at which the surface roughness at those regions 15*s* on the inner wall faces 15 with which the regulating bodies 10 made contact and the surface roughness at those regions 10*s* on the surfaces of the regulating bodies 10 with which the inner wall faces 15 made contact were respectively different.

The surface roughness Rz (indicated as inner wall face surface roughness Rz at TABLE 1) at those regions 15*s* on the inner wall faces 15 with which the regulating bodies 10 made contact and the surface roughness Rz (indicated as regulating body surface roughness Rz at TABLE 1) at those regions 10*s* on the surfaces of the regulating bodies 10 with which the inner wall faces 15 made contact at Samples 1 through 6 are shown in the following TABLE. These surface roughness Rz were measured using a surface profilometer (Surftest SJ-500 manufactured by Mitutoyo Corporation with 12AAC740 measurement probe (2× stylus/60° tip)). Discharge lamps were fabricated that incorporated the six types of anodes which had been prepared. Sample 1 through Sample 6 are shown in TABLE 1. Except for the surface roughness, the dimensions, materials, and so forth were the same at Sample 1 through Sample 6.

TABLE 1

| | Inner wall face surface roughness Rz (μm) | Regulating body surfaec roughness Rz (μm) | Maximum value of range of fluctuation in temerature TD (° C.) | Evaluation of range of fluctuation in temperature | Indentations on inner wall face? |
|---|---|---|---|---|---|
| Sample 1 | 1.57 | 2.00 | 6 | Good | No |
| Sample 2 | 1.17 | 1.28 | 4 | Good | No |
| Sample 3 | 1.35 | 1.55 | 8 | Good | No |
| Sample 4 | 5.73 | 1.74 | 13 | Not good | Yes |
| Sample 5 | 6.10 | 1.78 | 16 | Not good | Yes |
| Sample 6 | 10.38 | 2.22 | 27 | Not good | Yes |

The discharge lamps that respectively employed the anodes of Sample 1 through Sample 6 were made to repeatedly undergo 10 cycles of lit and unlit states in which 1 cycle included a lit time of 15 minutes and an unlit time of 120 minutes, and in which a rated power of 5 kW was input thereto with the anode 2 being in a vertical orientation such that it was located above the cathode 3. The surface temperatures of the anodes were measured during these 10 cycles using a radiation thermometer (IR-AHS2 manufactured by Chino).

The time during which temperature was measured at each cycle was the 5-minute period from 7 minutes following the start of lighting to 12 minutes thereafter. At 7 minutes following the start of lighting, the temperatures of the anodes 2 had risen adequately and the heat-transmitting substances 9 were molten. After the unlit time of 120 minutes, the anodes 2 had cooled and the heat-transmitting substances 9 had solidified. The measurement sampling rate of the radiation thermometer was 0.1 second.

The temperature measurement locations were four points separated by uniform spacing in the circumferential direction on the anode surface that were separated by 10 mm in the +Z direction along the Z1 axis from the anode tip surface. The measurement data was such that measurement data pertaining to a single cycle (5 minutes) at each measurement location was divided into 1-minute intervals, and the difference between the maximum value and the minimum value at the measurement data during each 1-minute interval was calculated. This difference represents the range of fluctuation in temperature during a 1-minute interval at a single measurement location.

That range of fluctuation in temperature which of the ranges of fluctuation in temperature at all of the measurement locations during the course of the 10 cycles was the largest range of fluctuation in temperature was taken to be the maximum value of the range of fluctuation in temperature TD. TABLE 1 shows the maximum value TD of the fluctuation in temperature for each of the respective Samples. TABLE 1 indicates that the maximum value TD of the range of fluctuation in temperature for Samples 1 through 3 was less than 13° C. It was therefore judged that the range of fluctuation in temperature was small, this being evaluated as good, at Samples 1 through 3. Because maximum values TD of the range of fluctuation in temperature that were 13° C. and higher were indicated for Samples 4 through 6, it was judged that the range of fluctuation in temperature was large, this being evaluated as not good, at Samples 4 through 6.

At Samples 1 through 3, the value of either the surface roughness Rz of the inner wall face or the surface roughness Rz of the regulating body was not greater than 1.52 μm. On the other hand, at Samples 4 through 6, the values of the surface roughness Rz of the inner wall face and the surface roughness Rz of the regulating body were both greater than 1.52 μm.

Here, in view of the Coulomb friction model which says that the coefficient of friction is determined by the surface roughness of the two objects, i.e., the regulating body 10 and the inner wall face 15, that are in mutual contact, causing the value of either the surface roughness Rz of the inner wall face 15 or the surface roughness Rz of the regulating body 10 to be not greater than 1.52 μm should make it possible to achieve a range of fluctuation in temperature that is less than 13° C.

Taking the foregoing into consideration, causing the surface roughness Rz of at least one of those region(s) on the inner wall face of the main body with which the regulating body makes contact or those region(s) on the surface of the regulating body with which the inner wall face makes contact to be not greater than 1.52 μm will make it possible to cause the range of local fluctuation in temperature of the anode 2 to be kept lower than 13° C. If such range of fluctuation in temperature exceeds 13° C., there is a possibility that the anode 2 will suffer damage and that the life of the discharge lamp 100 will be shortened.

Observation of Regulating Body Inclination

The anodes of Samples 1 through 6 were removed from the discharge lamps following completion of the foregoing testing, the anodes were respectively cut and disassembled, and observations were carried out with respect to the inner wall faces of the anodes. No particular defects were found at the inner wall faces 15 of Samples 1 through 3. At the inner wall faces 15 of Samples 4 through 6, indentations were found to be present at locations capable of coming in contact with the regulating bodies 10.

Based on these observations that were made with respect to the inner wall faces 15, it is speculated that the following may be occurring. At each of Samples 4 through 6, it is speculated that expansion of the regulating body 10 and convection of the heat-transmitting substance 9 caused the regulating body 10 to press on the same location at the inner wall face 15 for a long period of time, causing occurrence of an indentation. At each of Samples 1 through 3, it is speculated that, because the surface roughness Rz of those region(s) on the inner wall face of the main body with which the regulating body made contact and those region(s) on the surface of the regulating body with which the inner wall face made contact were small, even where expansion of the regulating body 10 and/or convection of the heat-transmitting substance 9 might have caused the regulating body 10 to temporarily press on the inner wall face 15, there was no formation of indentations because the regulating body 10 would have slid such that it did press on the same location for a long period of time.

The foregoing numeric range for surface roughness Rz assumes that the anode 2 has no history of use. But it has been found that there is a tendency for the surface roughness of the inner wall face 15 to gradually increase as it is affected by the heat which is produced by use of the anode 2 and there is occurrence of deformations resulting from high-temperature creep. For this reason, measurement of surface roughness may also be carried out in accordance with the foregoing method for an anode 2 that has a history of use, and if the results of measurement satisfy the foregoing numeric range, it may be speculated that the anode 2 would have satisfied the foregoing numeric range if it had been unused.

Second Embodiment

Figure 10:
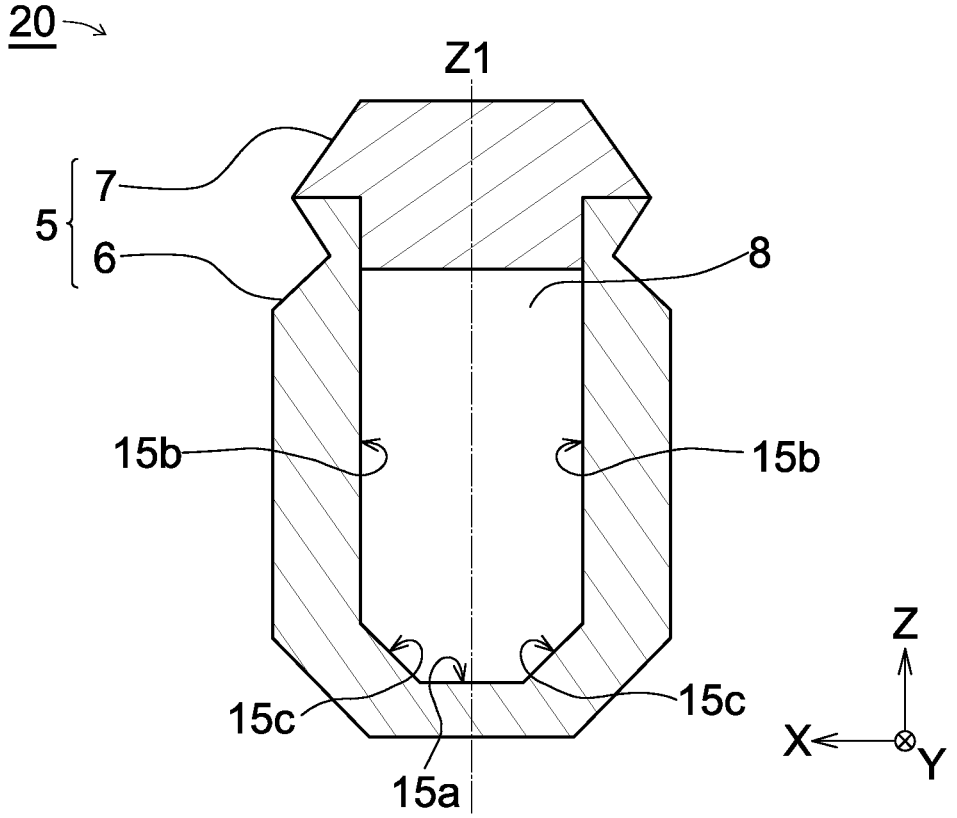
FIG. 10 Sectional view of the main body of an anode at a discharge lamp in accordance with a second embodiment.

An anode at a discharge lamp in accordance with a second embodiment will be described with reference to FIG. 10. At the anode 20, an inner wall face at a main body 5 has a first inner wall face 15*a* which is perpendicular to the axial direction (Z axis) at a tip portion of the main body 5, a second inner wall face 15*b* which extends in parallel fashion with respect to the axial direction, and a third inner wall face 15*c* which connects the first inner wall face 15*a* and the second inner wall face 15*b*, the second inner wall face 15*b* and the third inner wall face 15*c* being such that the surface roughness Rz thereof are not greater than 1.52 μm on the entire respective inner wall faces.

In other words, the second inner wall face 15*b* and the third inner wall face 15*c* include region(s) of the inner wall face 15 of the main body 5 with which the regulating body 10 does not make contact, regarding which it hardly need be said that there is no need to improve sliding of the regulating body 10 with respect to the region(s). However, by reducing the surface roughness of region(s) with which the regulating body 10 does not make contact, it will be possible to reduce formation of turbulence by the heat-transmitting substance 9 when the heat-transmitting substance 9 comes in contact with the second inner wall face 15*b* and the third inner wall face 15*c* as it undergoes convection. This will make it possible to reduce the range of fluctuation in temperature.

In accordance with a variation on the second embodiment, the first inner wall face 15*a* may be such that the surface roughness Rz thereof is not greater than 1.52 μm everywhere therealong. This will make it possible to reduce formation of turbulence by the heat-transmitting substance 9 when the flow of the heat-transmitting substance 9 comes in contact with the first inner wall face 15*a* as it undergoes convection. This will make it possible to reduce the range of fluctuation in temperature.

Above, respective embodiments have been described. The present invention should not be understood to be limited in any way by the foregoing embodiments, it being possible to make various improvements and modifications to the foregoing embodiments and variations thereon without departing from the gist of the present invention. Examples of improvements and modifications are indicated below.

There is no particular limitation with respect to the shape of the regulating body. Whereas it was indicated that the regulating body 10 appears cruciform in shape such that two plates intersect at a center which is the Z1 axis when viewed from a location thereabove (at the +Z side thereof) to a location therebelow (at the −Z side thereof), there is no limitation with respect to this shape. For example, the regulating body may be a shape constituted from a single plate. Furthermore, whereas when viewed in a horizontal direction (a direction perpendicular to the Z1 axis) the regulating body 10 had a tapered portion B1, the tapered portion B1 need not be present. That is, it may be made up of only a uniform diameter portion B2. Moreover, the uniform diameter portion B2 need not be present, in which case it might be made up entirely of a tapered portion B1.

Whereas the foregoing description was given in terms of an example in which the anode 2 had a heat-transmitting substance 9 and a regulating body 10, the cathode 3 might like the anode 2 also have a regulating body and a heat-transmitting substance. The discharge lamp 100 may be such that the cathode 3 is arranged at a location above the anode 2. The discharge lamp 100 may be such that the anode 2 and the cathode 3 are disposed in linear arrangement in a horizontal direction.

What is claimed is:

1. A discharge lamp in which a pair of electrodes are arranged in opposing fashion in an axial direction at an interior thereof, the discharge lamp being such that at least one of the electrodes, comprising at an interior of a main body of the electrode:

a heat-transmitting substance of the melting point lower than that of a material which makes up the main body; and a regulating body that is made up of a material of the melting point higher than that of the heat-transmitting substance, that includes at least one blade which extends in the axial direction and in a radial direction perpendicular to the axial direction, and that regulates convection of the heat-transmitting substance, wherein surface roughness Rz of at least one of a region which is on an inner wall face of the main body and with which the regulating body makes contact and a region which is on a surface of the regulating body and with which the inner wall face makes contact is not greater than 1.52 μm.

2. The discharge lamp according to claim 1, wherein surface roughness Rz of the region which is on the inner wall face of the main body and with which the regulating body makes contact and the region which is on the surface of the regulating body and with which the inner wall face makes contact are both not greater than 1.52 μm.

3. The discharge lamp according to claim 1, wherein the inner wall face comprises a first inner wall face which is perpendicular to the axial direction at a tip portion of the main body, a second inner wall face which extends in parallel fashion with respect to the axial direction, and a third inner wall face which connects the first inner wall face and the second inner wall face;

wherein the second inner wall face and the third inner wall face are such that surface roughness Rz thereof is not greater than 1.52 μm on the entire respective inner wall faces.

4. The discharge lamp according to claim 2, wherein the inner wall face comprises a first inner wall face which is perpendicular to the axial direction at a tip portion of the main body, a second inner wall face which extends in parallel fashion with respect to the axial direction, and a third inner wall face which connects the first inner wall face and the second inner wall face;

wherein the second inner wall face and the third inner wall face are such that surface roughness Rz thereof is not greater than 1.52 μm on the entire respective inner wall faces.

5. The discharge lamp according to claim 1, wherein the inner wall face comprises a first inner wall face which is perpendicular to the axial direction at a tip portion of the main body, a second inner wall face which extends in parallel fashion with respect to the axial direction, and a third inner wall face which connects the first inner wall face and the second inner wall face;

wherein the first inner wall face is such that surface roughness Rz thereof is not greater than 1.52 μm on the entire inner wall face.

6. The discharge lamp according to claim 2, wherein the inner wall face comprises a first inner wall face which is perpendicular to the axial direction at a tip portion of the main body, a second inner wall face which extends in parallel fashion with respect to the axial direction, and a third inner wall face which connects the first inner wall face and the second inner wall face;

wherein the first inner wall face is such that surface roughness Rz thereof is not greater than 1.52 μm on the entire inner wall face.

7. The discharge lamp according to claim 3, wherein the inner wall face comprises a first inner wall face which is perpendicular to the axial direction at a tip portion of the main body, a second inner wall face which extends in parallel fashion with respect to the axial direction, and a third inner wall face which connects the first inner wall face and the second inner wall face;

wherein the first inner wall face is such that surface roughness Rz thereof is not greater than 1.52 μm on the entire inner wall face.

8. The discharge lamp according to claim 4, wherein the inner wall face comprises a first inner wall face which is perpendicular to the axial direction at a tip portion of the main body, a second inner wall face which extends in parallel fashion with respect to the axial direction, and a third inner wall face which connects the first inner wall face and the second inner wall face;

wherein the first inner wall face is such that surface roughness Rz thereof is not greater than 1.52 μm on the entire inner wall face.

9. An electrode which is arranged at an interior of a discharge lamp and which exhibits a shape of a solid of revolution, the electrode, comprising at an interior of a main body of the electrode:

a heat-transmitting substance of the melting point lower than that of a material which makes up the main body; and a regulating body that is made up of a material of the melting point higher than that of the heat-transmitting substance, that includes at least one blade which extends in an axial direction of the solid of revolution and in a radial direction perpendicular to the axial direction, and that regulates convection of the heat-transmitting substance, wherein surface roughness Rz of at least one of a region which is on an inner wall face of the main body and with which the regulating body makes contact and a region which is on a surface of the regulating body and with which the inner wall face makes contact is not greater than 1.52 μm.

10. A method for manufacturing an electrode of a discharge lamp comprising the steps of:

preparing a main body having an internal space and making up the electrode which is arranged at an interior of the discharge lamp; a heat-transmitting substance of the melting point lower than that of the main body; and a regulating body that is for regulating convection of the heat-transmitting substance and that exhibits a size permitting insertion within the internal space such that a gap intervenes therebetween; and polishing so as to cause surface roughness Rz of at least one of a region which is on an inner wall face of the main body and with which the regulating body makes contact and a region which is on a surface of the regulating body and with which the inner wall face makes contact is not greater than 1.52 μm.

* * * * *